United States Patent [19]

Fukuda et al.

[11] Patent Number: 4,526,130

[45] Date of Patent: Jul. 2, 1985

[54] DEVELOPING APPARATUS

[75] Inventors: Kozi Fukuda; Keitaro Yamashita, both of Saitama, Japan

[73] Assignee: Hitachi Metals, Ltd., Tokyo, Japan

[21] Appl. No.: 461,195

[22] Filed: Jan. 26, 1983

[30] Foreign Application Priority Data

Feb. 3, 1982 [JP] Japan ..... 57-15907

[51] Int. Cl.[3] ..... G03G 15/09

[52] U.S. Cl. ..... 118/657; 355/3 DD; 355/3 CH

[58] Field of Search ..... 118/657; 355/3 DD, 3 CH

[56] References Cited

FOREIGN PATENT DOCUMENTS 133857 9/1979 Japan .

2088252 6/1982 United Kingdom .

*Primary Examiner*—Bernard D. Pianalto

*Attorney, Agent, or Firm*—Finnegan, Henderson, Farabow, Garrett & Dunner

[57] ABSTRACT

In a developing apparatus comprising an image support having a latent image formed on the surface, a cylindrical sleeve made of a non-magnetic metal material placed so as to face the image support, and a magnetic field-generating means placed in said sleeve, said image support and said sleeve being arranged so that a magnetic developer held on said sleeve can be conveyed to the surface of the aforesaid image support, thereby developing the aforesaid latent image, a conductive or semi-conductive coating layer having a thickness of at least 1 μm, a hardness of HV 900 or more and a specific resistance of $10^6$ Ω·cm or less is formed on the surface of said sleeve. This makes the conveyance of the developer good, and enables the development to be well conducted and the wear of the sleeve to be reduced.

4 Claims, 3 Drawing Figures

DEVELOPING APPARATUS

This invention relates to a developing apparatus for developing a latent image formed on an image support with a dry magnetic developer in copying methods utilizing electrophotography or electrostatic recording or in magnetic recording methods.

It is known that in an electrophotographic copying machine, an electrostatic latent image is formed by, for example, electrification or exposure on the surface of a support, e.g., an inorganic photosensitive material such as photoconductive selenium, a layer in which photoconductive zinc oxide is dispersed in an insulating resin binder, or the like; or an organic photoconductor such as polyvinylcarbazole, poly-N-vinylcarbazole or the like, after which the electrostatic latent image is developed by a magnetic brush method. Also in electrostatic recording such as facsimile, there is generally employed a method by which an electrostatic latent image is formed on the surface of a dielectric such as an electrostatic recording paper by means of, for example, needle electrodes and then similarly developed by a magnetic brush method. In addition, the development of a magnetic latent image by a magnetic brush method is carried out also in a magnetic recording apparatus in which a magnetic latent image is formed on a magnetic drum by means of, for example, a stylus head, developed, and then transferred onto a transfer sheet.

When latent images formed, as mentioned above, on various image supports are developed by a magnetic brush method or the like, there is used, as a magnetic developer, a binary developer consisting of a ferromagnetic carrier such as iron, steel, nickel, ferrite or the like and a toner prepared by dispersing, for example, a coloring agent such as a pigment, a dye or the like in a resin, or a one-component magnetic toner comprising, as the main constituents, a resin and magnetic fine particles such as magnetite or metal powder.

As a means for conveying the magnetic developer to a development zone, there is used a magnet roll in which a means for generating a magnetic field having a plurality of magnetic poles on the surface is placed in the inside of a cylindrical sleeve made of a non-magnetic material such as aluminum, stainless steel or the like, as described in, for example, Japanese Patent Publication No. 14,718/62, Japanese Utility Model Registration No. 19,884/76, etc. The magnet roll is placed in the inside or outside of a container for the developer, and is constructed so that the developer can be conveyed along the sleeve surface by relative revolution of the sleeve and the magnetic field-generating means.

It is well known that in the aforesaid magnet roll, the sleeve surface is roughened for good conveyance of the developer. For instance, the formation of knurled grooves is described in Japanese Patent Application Kokai (Laid-Open) No. 79,043/79, and the surface treatment such as blasting, metallizing or the like in addition to knurling is described in Japanese Patent Application Kokai (Laid-Open) No. No. 26,526/80. However, when the sleeve surface is roughened by knurling, the number of working steps becomes large, and therefore, it is disadvantageous for a material poor in workability, particularly stainless steel, and in the case of a soft material such as aluminum, the wear is serious, so that any good result cannot be obtained. Further, when sand blast is applied to the surface of a sleeve made of stainless steel, the surface is somewhat hardened owing to working strain but not sufficiently hardened, and there has been a problem of serious wear because the wear resistance of stainless steel per se is low. In addition to this method, as a method for making the surface of a sleeve highly hard, it is also known to form an anodic oxidation coating film (Alumite) or the like on the sleeve surface made of an aluminum alloy (A5056, A6063, A2017 or the like). However, when it is required that electric current flows between the sleeve surface and a magnetic developer to be conveyed thereon, the anodic oxidation coating film having an insulating property does not bring about any good result.

The object of this invention is to provide a developing apparatus which has been freed from the disadvantages of the above-mentioned prior art, enables a developer to be well conveyed and good development to be conducted, and has a sleeve very excellent in wear resistance.

According to this invention, there is provided a developing apparatus comprising an image support having a latent image formed on the surface, a cylindrical sleeve made of a non-magnetic metal material placed so as to face the image support, and a magnetic field-generating means placed in said sleeve, the aforesaid image support and the aforesaid sleeve being arranged so that a magnetic developer held on said sleeve can be conveyed to the surface of the aforesaid image support, thereby developing the aforesaid latent image, characterized in that on the surface of the aforesaid sleeve is formed a conductive or semi-conductive coating layer having a thickness of at least 1 $\mu$m, a hardness of HV900 or more and a specific resistance of $10^6$ $\Omega$·cm or less.

BRIEF DESCRIPTION OF THE DRAWING

This invention is explained below in detail referring to the accompanying drawings, in which.

DETAILED DESCRIPTION OF THE DRAWING

Figure 1:
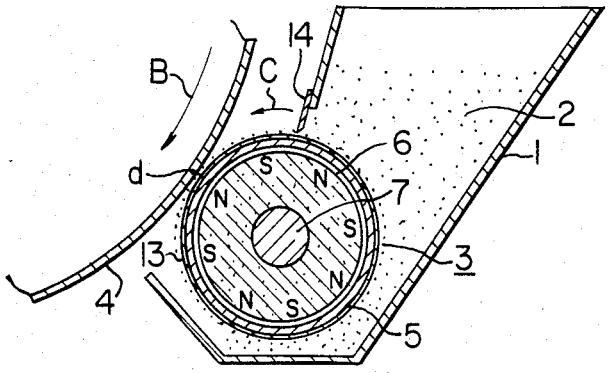
FIG. 1 is a cross-sectional view of one example of the developing apparatus of this invention.
Figure 2:
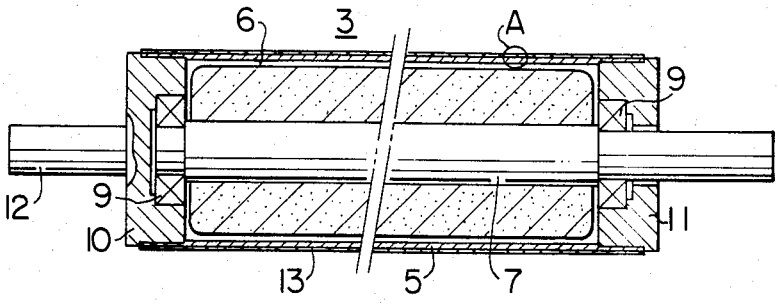
FIG. 2 is an axial cross-sectional view of the magnet roll in FIG. 1.

In FIGS. 1 and 2, a one-component magnetic toner 2 contained as a magnetic developer in a toner container 1. In the lower part of the toner container 1, a magnet roll 3 is placed so as to face a photosensitive material drum 4, which is moved in the direction B shown by an arrow in the drawings.

The magnet roll 3 has a sleeve 5 made of aluminum having a coating layer 13, which has high hardness and a relatively good electrical conductivity, and a cylindrical magnetic member 6 placed in the sleeve 5. The cylindrical magnetic member 6 is composed of a cylindrical magnet and fixed on a shaft 7 which is coaxial with the sleeve 5. The cylindrical magnetic member 6 has a plurality of magnetic poles on its circumferential surface. The cylindrical magnetic member 6 is journaled through bearings 9 to end walls 10 and 11 secured on both ends of the sleeve 5. The cylindrical magnetic member 6 and/or the sleeve 5 can be rotated by rotating one end of the shaft 7 and/or the shaft 12 of the end wall 10.

In the above-mentioned developing apparatus, the magnetic toner 2 adsorbed on the sleeve 5 by the magnetic attracting force of the magnet is conveyed in the direction C shown by an arrow in the drawings, for example, by rotating the sleeve 5 in the same direction while fixing the cylindrical magnetic member 6. That is to say, the thickness of the magnetic toner 2 on the sleeve is controlled by a doctor blade 14, and then conveyed toward a development zone d which is formed in the part of the sleeve 5 facing the photosensitive material drum 4. An electrostatic latent image formed on the surface of the photosensitive material drum 4 is developed by brushing the surface of the photosensitive material drum 4 by means of a magnetic brush formed in the development zone d. The magnetic toner 2 passed through the development zone d is conveyed on the sleeve 5 in the direction C shown by an arrow in the drawings and recovered into the toner container 1.

When the magnetic toner is thus conveyed toward the development zone d, it is necessary for good conveyance of the magnetic toner that the sleeve surface should be rough in order to prevent slip from occuring between the sleeve surface and the magnetic toner and should hardly be worn. In order to secure the development, it is at least required that the specific resistance of the sleeve surface be $10^6$ Ω·cm or less. Nickel chemical plating is known as one of the surface treatments of aluminum or aluminum alloys. It is also known that a hardness of about HV500 can be obtained particularly when the surface of aluminum or aluminum alloy is plated with a Ni-P alloy containing 5 to 10% by weight of P, and that a hardness of HV900 or more can be obtained by heating the plated surface. As other surface treatments, there are also known ion-plating and physical vapor deposition of a nitride such as Ti-N, Cr-N or the like or a carbide such as B-C, Ti-C, Hf-C or the like by sputtering. The present inventors have conducted extensive research to find that by subjecting the surface of the sleeve 5 to nickel chemical plating or vapor deposition of a nitride or a carbide, a coating layer having a high hardness and a good electric conductivity can be obtained, so that a very good result can be obtained.

Figure 3:
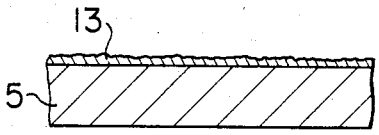
FIG. 3 is an enlarged cross-sectional view of the part A in FIG. 2.

In detail, in the case of, for example, nickel chemical plating, a plated layer 13 having a hardness of HV900 or more is formed by pickling and degreasing the surface of the sleeve 5, subjecting it to pretreatment by a zincate method, and then subjecting it to chemical plating with a Ni-P alloy containing 5 to 10% by weight of P, followed by heat treatment. In this case, the hardness of the plated layer can be increased to about HV1,000 to 1,100 by improving the heat treatment. Microcopically, the surface of the thus obtained plated layer has been properly roughened as shown in FIG. 3, and therefore, the magnetic toner is prevented from slipping in the step of conveying the toner, so that the conveyance of the toner can greatly be improved. The surface roughness of the plated layer is sufficiently about 0.1 s to 3 s. It is sufficient that the thickness of the plated layer be at least 1 μm from the viewpoint of plating strength. It is more effective to roughen the sleeve surface previously by a method such as sand blasting or the like before the plating treatment. Since the plated layer has a very high hardness as described about, it is not worn by contact with the toner even when used for a long time. The surface roughness unit (s or $R_Z$) in this invention is as defined in JIS B 0601.

EXAMPLE 1

In FIG. 1, the surface of an aluminum sleeve 5 having an outside diameter of 32 mmϕ was subjected to nickel chemical plating in the manner described above to form a coating layer 13 of a Ni-P alloy having a thickness of 5 μm. The surface roughness of the plated layer 13 was about 0.5 s, and its hardness ranged from HV1,000 to HV1,051. Subsequently, 30 parts by weight of an epoxy resin (Epikote 1002 manufactured by Shell Chemical Co., Ltd.) and 70 parts by weight of magnetite (EPT500 manufactured by Toda Industry Co., Ltd.) were kneaded with heating, cooled to be solidified, ground, and then subjected to spheroidizing treatment, after which 0.4 part by weight of carbon black (#44 manufactured by Mitsubishi Chemical Co., Ltd.) was mixed therewith to obtain a magnetic toner having an average particle size of 15 μm. By use of the magnetic toner, 100,000 sheets were continuously subjected to copy test by rotating the sleeve 5 to 200 r.p.m. As a result, the sleeve surface was not worn and good conveyance could be carried out. When a rough surface having a 10-point average roughness $R_Z=2$ μm was formed by sand-blasting treatment before the plating, the conveyance of the toner was more secured, and an improvement of the quality of the copies was confirmed.

In this case, the doctor gap was set at 0.4 mm, and the development gap at 0.3 mm, and a selenium drum having an outside diameter of 120 mmϕ was used as a photosensitive material and rotated at a peripheral speed of 100 mm/sec. As the magnet, there was used a cylindrical barium ferrite magnet having an outside diameter of 29 mmϕ subjected to octipolar symmetric magnetization.

EXAMPLE 2

The same procedure as in Example 1 was repeated, except that instead of carrying out the nickel chemical plating, a Ti-N layer of 1 μm in thickness was formed on the sleeve surface using an ion plating method. As a result, there could be obained a result equal or superior to that obtained in Example 1.

COMPARATIVE EXAMPLE

For comparison, a copying test was carried out under the same conditions as in Example 1, except that the sleeve subjected to the chemical plating was replaced by a stainless-steel sleeve whose surface had been subjected to sand-blasting to be given a surface roughness of about 0.5 s. As a result, when about 10,000 copies were made, the sleeve surface was worn away, resulting in unsatisfactory conveyance. As a result of an experiment carried out under the same conditions as described above, except that an anodic oxidation coating film was formed on an aluminum sleeve, the electric current flowing between the toner layer and the sleeve became unsatisfactory, so that the development efficiency was decreased, resulting in deterioration of image.

As described above, this invention can bring about such excellent effects that the conveyance of a developer is greatly improved and the improved conveyance is even after the apparatus is used for a long time.

Although a magnetic toner was used as a magnetic developer in the above explanation, a good result could be obtained not only in this case but also when a binary developer was used. As the magnet, not only cylindrical one but also cylindrically arranged block magnets may, of course, be used. The material for the sleeve is not limited to aluminum but may be any nonmagnetic metal such as stainless steel, brass or the like.

What is claimed is:

1. A developing apparatus comprising an image support having a latent image formed on the surface, a cylindrical sleeve made of an aluminum alloy placed so as to face the image support, and a magnetic field-generating means placed in said sleeve, said image support and said sleeve being arranged so that a magnetic developer held on said sleeve can be conveyed to the surface of the aforesaid image support, thereby developing the aforesaid latent image, characterized in that on the surface of the aforesaid sleeve is formed a Ni-P alloy coating layer having a thickness of at least 1 μm, a hardness of at least HV900 and a specific resistance of $10^6$ Ω·cm or less.

2. A developing apparatus according to claim 1, wherein the surface roughness of the sleeve ranges from 0.1 s to 3 s..

3. The developing apparatus according to claim 2, wherein the coating layer is a coating of a Ni-P alloy having a thickness of 5 μm and a hardness of HV1000 to HV1500.

4. A developing apparatus according to claim 1, wherein the coating layer is a coating of a Ni-P alloy having a thickness of 5 μm and a hardness of HV1,000 to HV1,500.

* * * * *